US012528644B2

(12) United States Patent
Lai

(10) Patent No.: US 12,528,644 B2
(45) Date of Patent: Jan. 20, 2026

(54) STORAGE TANK

(71) Applicant: PA.E Machinery Industrial Co., Ltd., Taichung (TW)

(72) Inventor: Ming-Yu Lai, Taichung (TW)

(73) Assignee: PA.E MACHINERY INDUSTRIAL CO., LTD., Taichung (TW)

( * ) Notice: Subject to any disclaimer, the term of this patent is extended or adjusted under 35 U.S.C. 154(b) by 78 days.

(21) Appl. No.: 18/765,833

(22) Filed: Jul. 8, 2024

(65) Prior Publication Data

US 2025/0304363 A1 Oct. 2, 2025

(30) Foreign Application Priority Data

Mar. 27, 2024 (TW) ..... 113111528

(51) Int. Cl.
*B65D 90/14* (2006.01)
*B65D 88/12* (2006.01)

(52) U.S. Cl.
CPC ..... *B65D 90/146* (2013.01); *B65D 88/128* (2013.01)

(58) Field of Classification Search
CPC ..... F24D 3/082; F16K 15/1823; F16K 5/06; B65D 88/06; B65D 88/02; B65D 88/706; B65D 83/44; B65D 83/425; B65D 77/225; B65D 90/146; B65D 88/128; B65D 90/12
See application file for complete search history.

(56) References Cited

U.S. PATENT DOCUMENTS 4,531,656 A * 7/1985 Nitchman ..... B67D 1/0829 215/901
5,597,085 A * 1/1997 Rauworth ..... B65D 77/06 220/639
6,666,358 B1 * 12/2003 Field ..... B67D 1/0832 222/400.7
10,000,326 B2 * 6/2018 Apps ..... B65D 11/08

* cited by examiner

*Primary Examiner* — Kareen K Thomas
(74) *Attorney, Agent, or Firm* — Michael Best & Friedrich LLP

(57) ABSTRACT

A storage tank includes a body, a stand, and a ball valve. The body includes a top portion, a bottom portion, and a lateral wall portion that interconnects the top portion and the bottom portion. The stand is detachably disposed on the top portion or the bottom portion. The stand includes a base and a plurality of supporting arms. The stand has an opening that is formed on one of the plurality of supporting arms. Each of the plurality of supporting arms includes a supporting wall and a surrounding wall. The supporting wall cooperates with the surrounding wall to define an accommodating space. The ball valve includes a primary pipe and a secondary pipe. The primary pipe is received in the accommodating space of the one of the plurality of supporting arms. The secondary pipe extends through the opening of the one of the plurality of supporting arms.

8 Claims, 6 Drawing Sheets

STORAGE TANK

CROSS-REFERENCE TO RELATED APPLICATION

This application claims priority to Taiwanese Invention Patent Application No. 113111528, filed on Mar. 27, 2024, the entire disclosure of which is incorporated by reference herein.

FIELD

The disclosure relates to a storage tank, and more particularly to a water storage tank.

BACKGROUND

When a conventional storage tank is being packaged and sealed, a ball valve will be included in the packaging for an assembly purpose later on. During packaging, if the ball valve is directly mounted to a connection pipe of the storage tank and then the storage tank along with the ball valve are sealed, the ball valve may be impacted and damaged during transportation of the storage tank. In order to solve this problem, the ball valve is usually packaged separately, or hanged on the storage tank and sealed together with the storage tank.

However, the aforesaid two packaging approaches still fail to address some problems. Packaging the ball valve separately will lead to a waste of packaging materials, and hanging the ball valve on the storage tank cannot completely guarantee that the ball valve would not be damaged during transportation of the storage tank.

SUMMARY

Therefore, an object of the disclosure is to provide a storage tank that can alleviate at least one of the drawbacks of the prior art.

According to the disclosure, the storage tank includes a body, a stand, and a ball valve.

The body includes a top portion, a bottom portion that is opposite to the top portion, and a lateral wall portion that interconnects the top portion and the bottom portion.

The stand is detachably disposed on the top portion or the bottom portion of the body. The stand includes a base, and a plurality of supporting arms that are connected to the base. The stand has an opening that is formed on one of the plurality of supporting arms. Each of the plurality of supporting arms includes a supporting wall for abutting against the top portion or the bottom portion of the body, and a surrounding wall that is connected to a periphery of the supporting wall. The supporting wall cooperates with the surrounding wall to define an accommodating space. The opening is formed on the surrounding wall of the one of the supporting arms and is in spatial communication with the accommodating space.

The ball valve includes a primary pipe, and a secondary pipe that is transversely connected to the primary pipe. The primary pipe is configured to be received in the accommodating space of the one of the plurality of supporting arms. The secondary pipe is configured to extend through the opening that is formed on the one of the plurality of supporting arms.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
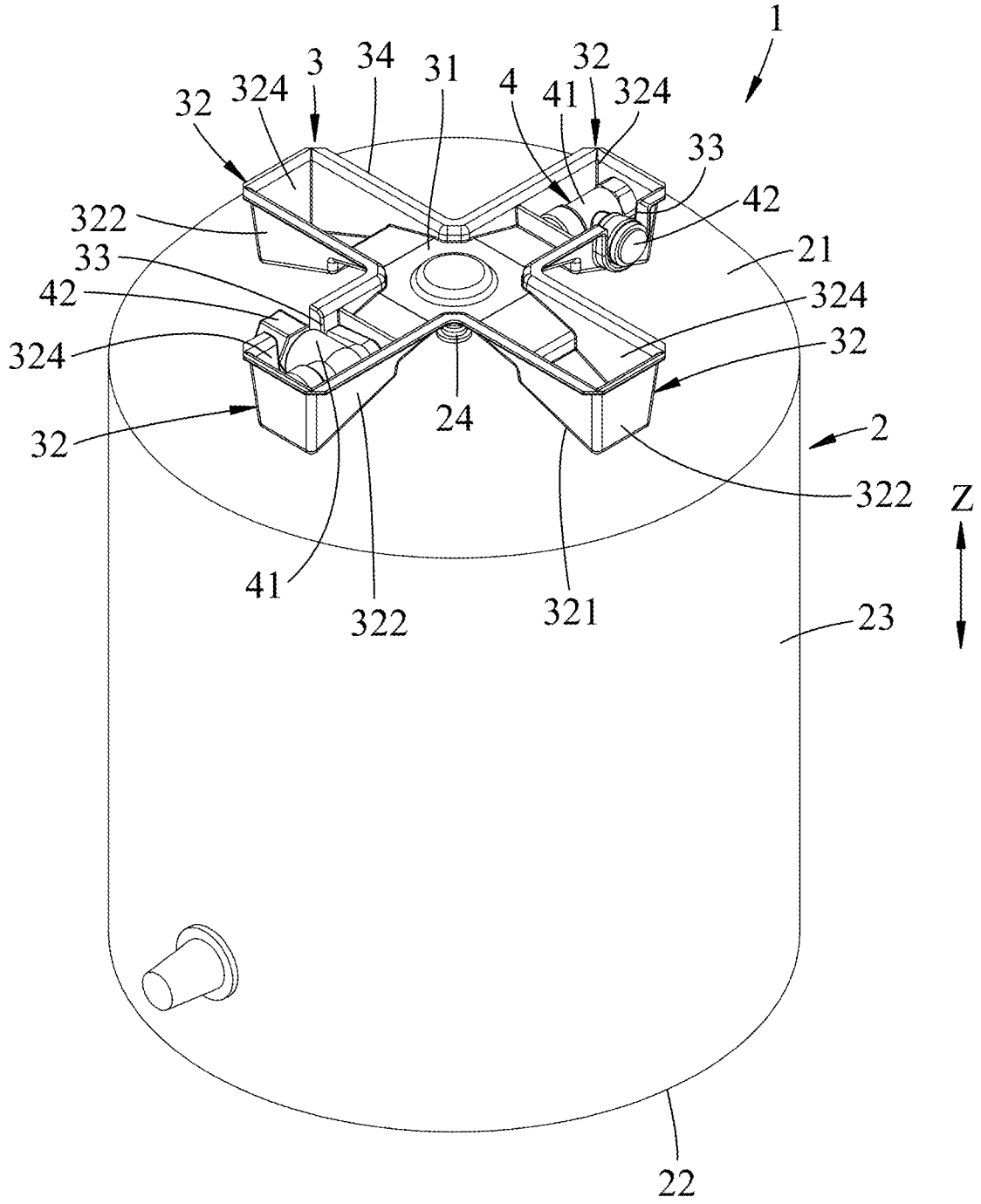
FIG. 1 is a perspective view illustrating a storage tank according to an embodiment of the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
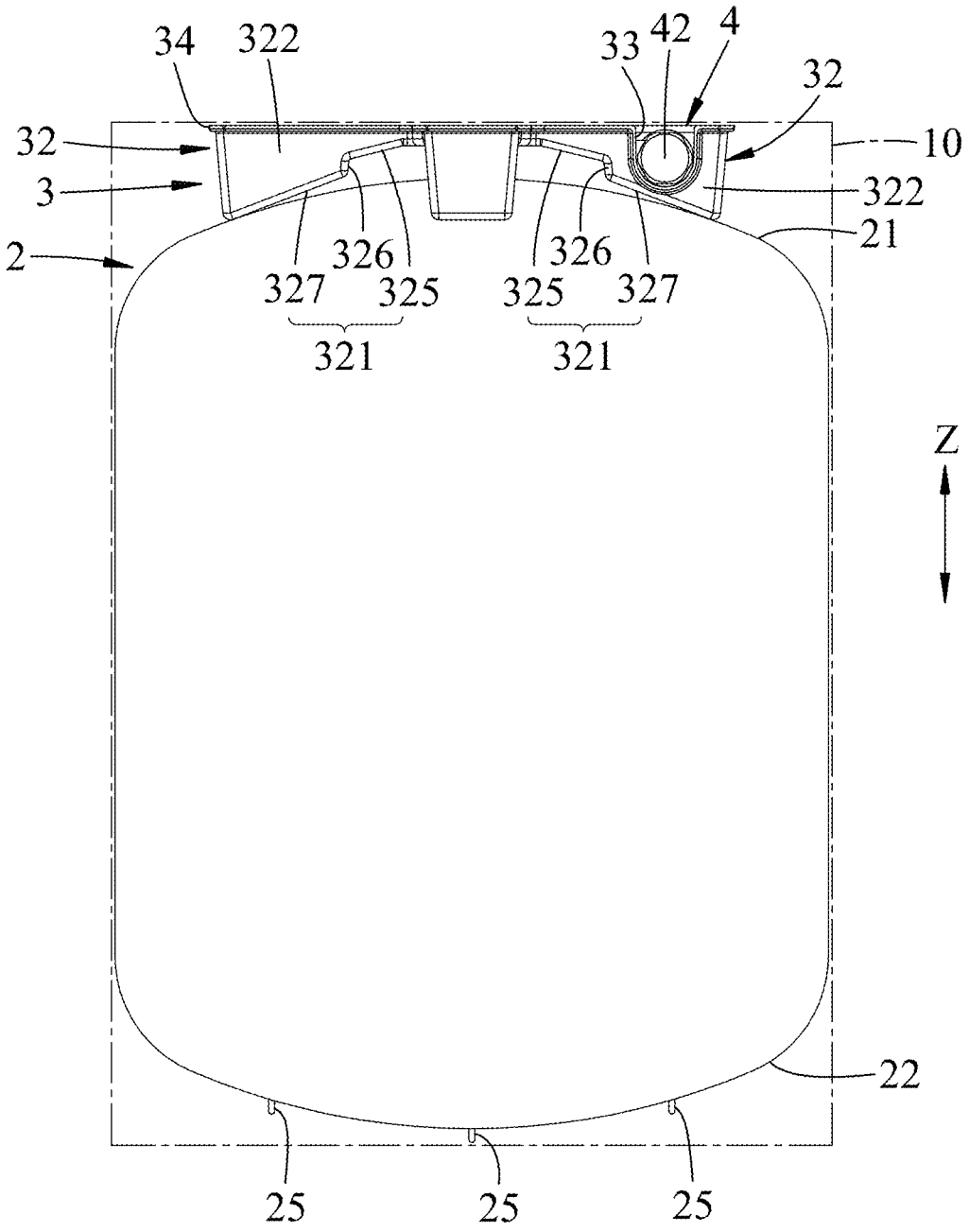
FIG. 2 is a front view illustrating the storage tank that is being packaged in a box according to an embodiment of the present disclosure.
Figure 3:
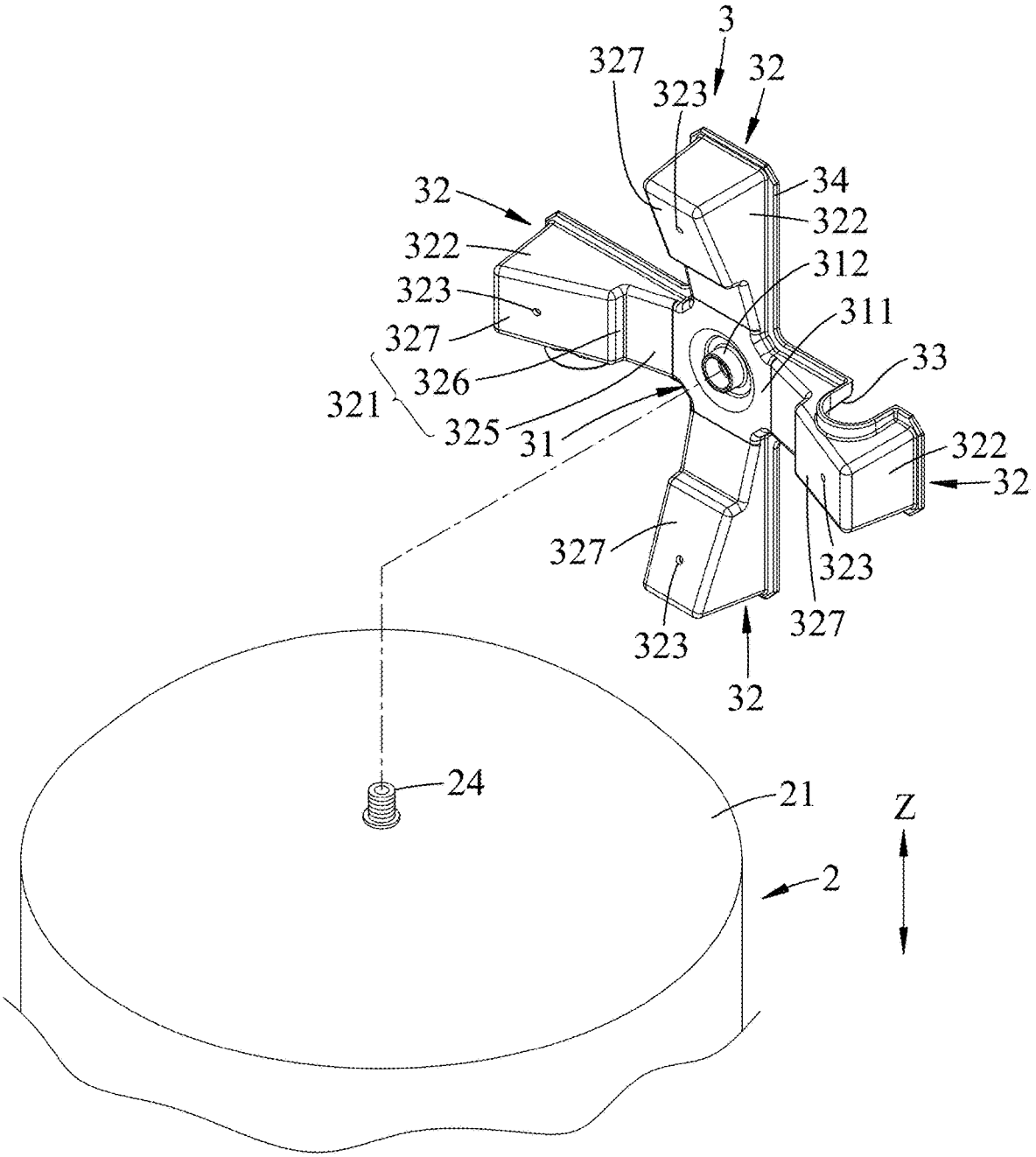
FIG. 3 is a fragmentary exploded view illustrating a stand and a top portion of the storage tank according to an embodiment of the present disclosure.

A storage tank 1 according to an embodiment of this disclosure includes a body 2, a stand 3, and a ball valve 4. Referring to FIGS. 1 to 3, in this embodiment, a number of the ball valves 4 is two.

The body 2 includes a top portion 21, a bottom portion 22 that is opposite to the top portion 21 along an up-down direction (Z), a lateral wall portion 23 that interconnects the top portion 21 and the bottom portion 22, a connection pipe 24 that is disposed on the top portion 21, and a plurality of positioning columns 25 that are spaced apart from each other and that are disposed on the bottom portion 22. In this embodiment, the top portion 21 and the bottom portion 22 are curvedly shaped, and a number of the plurality of positioning columns 25 is four (only three of the positioning columns 25 are shown in FIG. 2).

Figure 4:
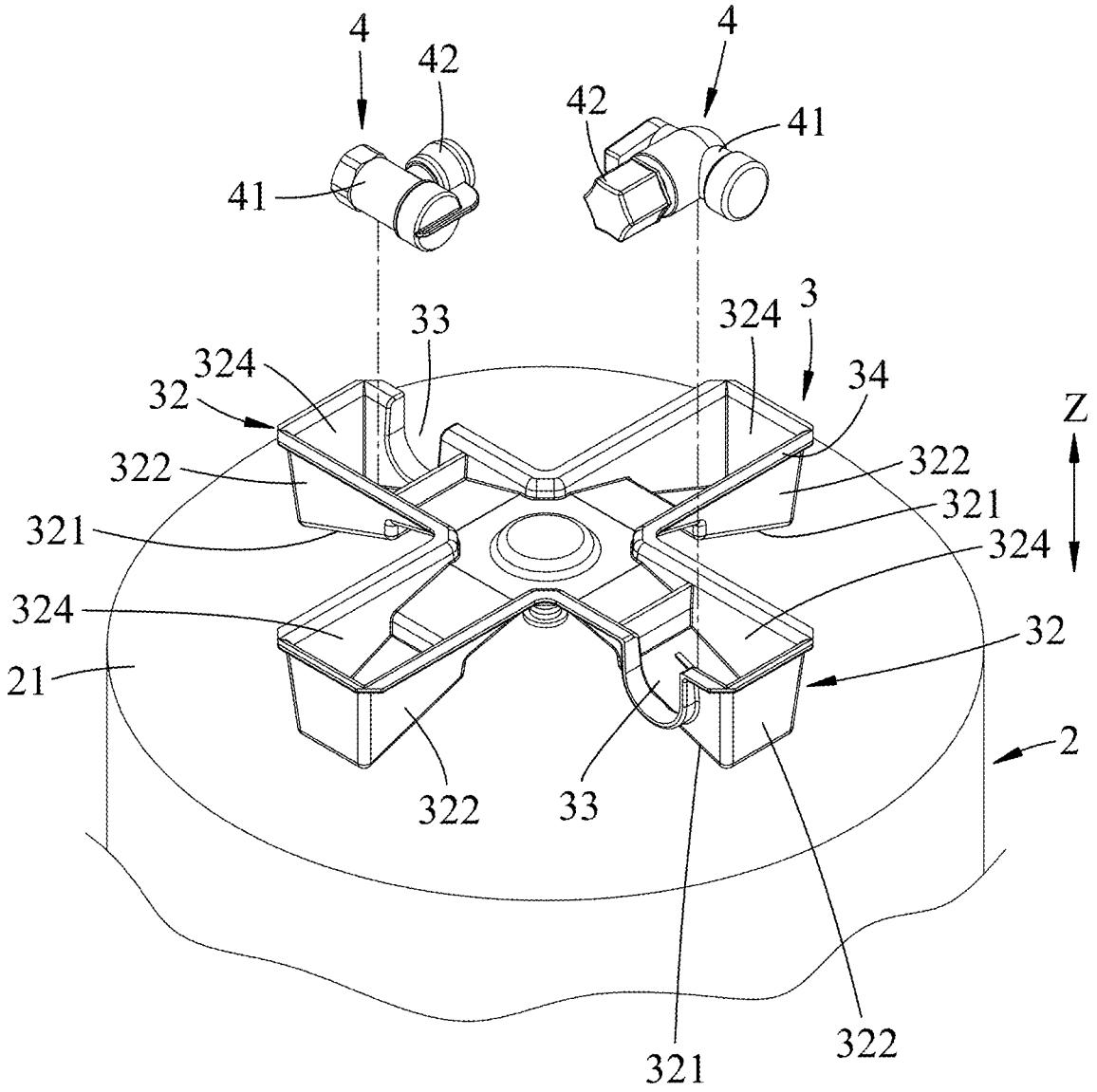
FIG. 4 is a fragmentary exploded view illustrating two ball valves and accommodating spaces of the stand according to an embodiment of the present disclosure.
Figure 5:
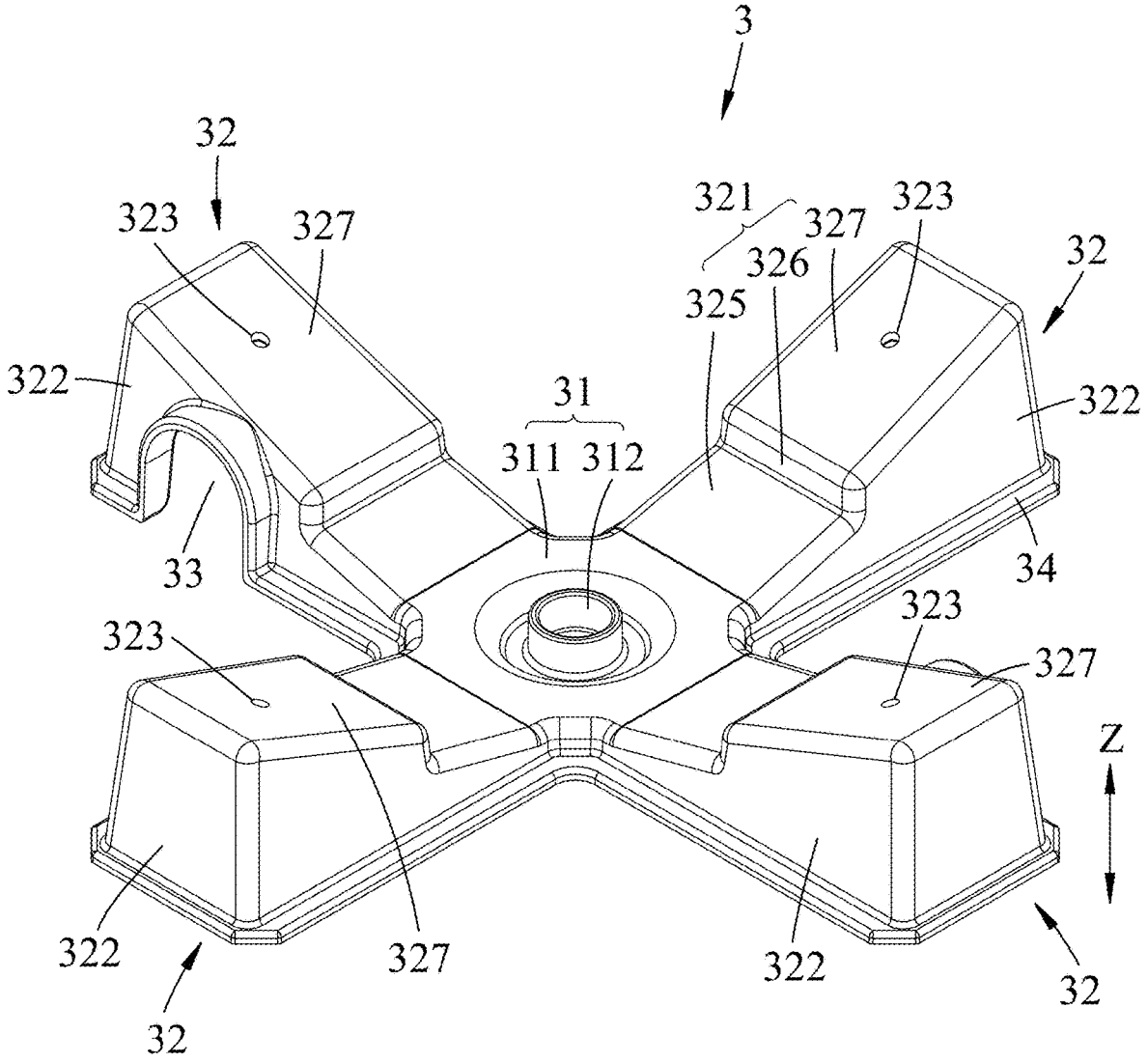
FIG. 5 is a perspective view illustrating a stand according to an embodiment of the present disclosure.

Referring to FIGS. 3 to 5, in this embodiment, the stand 3 is exemplified as a cross-shaped structure, and is detachably disposed on the top portion 21 or the bottom portion 22 (see FIG. 6) of the body 2. The stand 3 includes a base 31, a plurality of supporting arms 32 that are connected to the base 31, an opening 33 that is formed on one of the plurality of supporting arms 32, and a flange 34 that is disposed on the plurality of supporting arms 32. In this embodiment, the stand 3 includes four of the plurality of supporting arms 32, and has two of the openings 33. The openings 33 are respectively formed on two of the supporting arms 32.

The base 31 has a basal surface 311, and a pipe socket 312 that is disposed on the basal surface 311. The pipe socket 312 is sleeved on the connection pipe 24 when the stand 3 is disposed on the top portion 21 of the body 2.

The supporting arms 32 are angularly spaced apart from each other around the base 31. Each of the supporting arms 32 includes a supporting wall 321 that is connected to the basal surface 311 and a surrounding wall 322 that is connected to a periphery of the supporting wall 321, and has a positioning hole 323 that is formed on the supporting wall 321. The supporting wall 321 cooperates with the surrounding wall 322 to define an accommodating space 324.

The supporting wall 321 is configured for abutting against the top portion 21 or the bottom portion 22 (see FIG. 6) of the body 2. The supporting wall 321 of each of the supporting arms 32 includes a connecting part 325 that is connected to the basal surface 311, an elevating part 326 that is connected to the connecting part 325, and an abutting part 327 that is connected to the elevating part 326. Specifically, the connecting part 325 extends outward from and obliquely with respect to the basal surface 311, the elevating part 326 is positioned between and connected to the connecting part 325 and the abutting part 327 along a direction substantially parallel to the up-down direction (Z), and the abutting part 327 extends from the elevating part 326 and is inclined toward the body 2 so as to conform to the shapes of the top portion 21 and the bottom portion 22 of the body 2.

The surrounding walls 322 of the supporting arms 32 are adjacently connected to each other.

Figure 6:
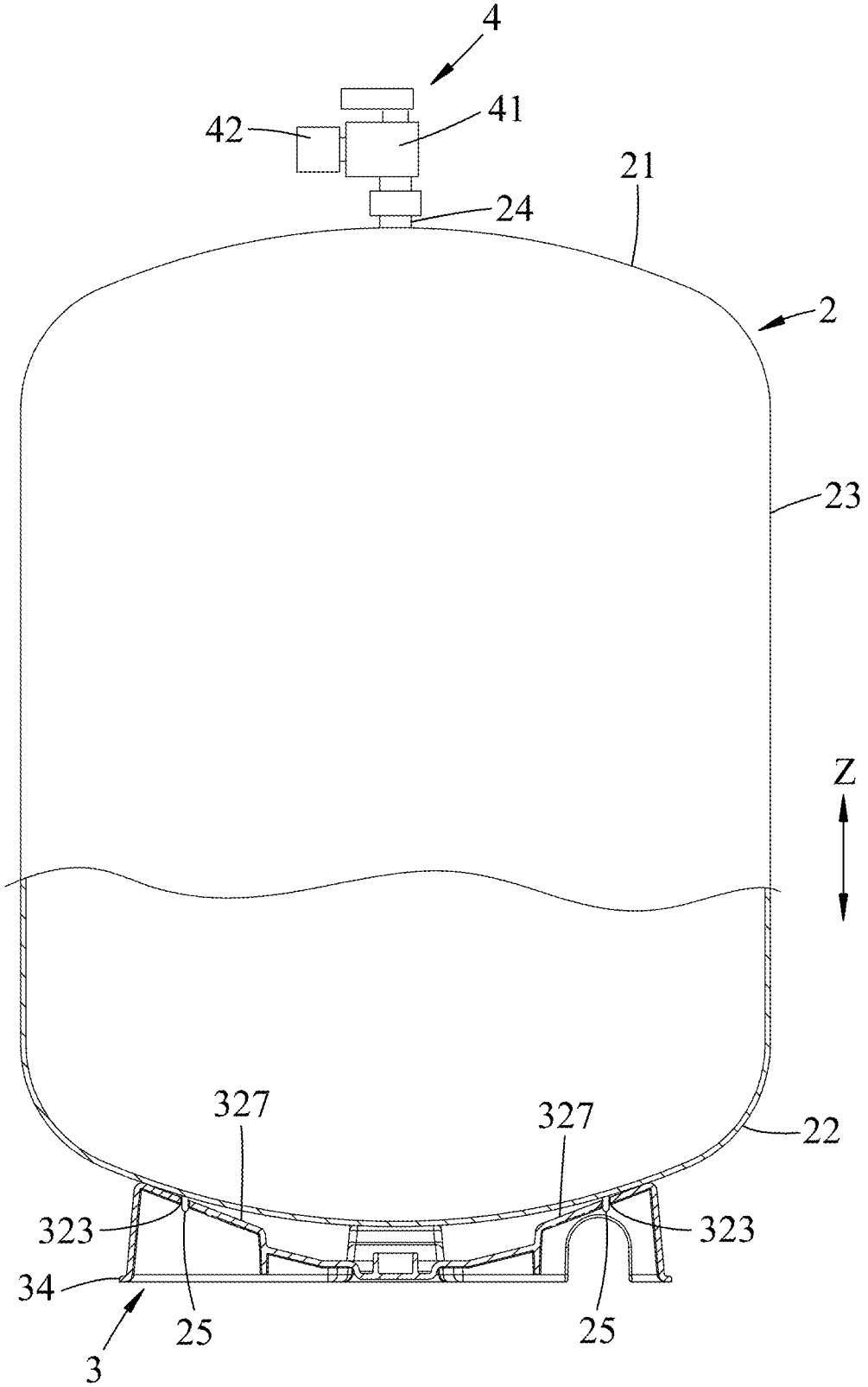
FIG. 6 is a partial sectional view illustrating the storage tank that has been assembled for use according to an embodiment of the present disclosure.

Referring to FIGS. 2, 5 and 6, the positioning holes 323 of the supporting arms 32 correspond respectively with the positioning columns 25 of the body 2. When the stand 3 is disposed on the bottom portion 22 of the body 2, the positioning columns 25 are inserted into the positioning holes 323 of the supporting arms 32, respectively.

It should be noted that a number of the supporting arms 32 is not limited to four. In other embodiments, the number of the supporting arms 32 may be three or more than four.

Referring to FIG. 4, the openings 33 are respectively formed on the surrounding walls 322 of the two of the supporting arms 32, and are in spatial communication with the accommodating spaces 324 of the two of the supporting arms 32.

Referring to FIG. 5, the flange 34 is disposed at an end of the surrounding walls 322 of the supporting arms 32 and extends outward from the end of the surrounding walls 322 and from edges of the openings 33 along a direction that is transverse to the up-down direction (Z). The end of the surrounding walls 322 of the supporting arms 32 is opposite to the supporting walls 321 of the supporting arms 32.

Referring to FIGS. 2 and 6, when the stand 3 is disposed on the top portion 21 or the bottom portion 22, the abutting parts 327 of the supporting arms 32 cooperatively abut against the top portion 21 or the bottom portion 22 that are curvedly shaped, so that the flange 34 is parallel to a transverse plane of the body 2. In this embodiment, the transverse plane is transverse to the up-down direction (Z).

Referring to FIGS. 1, 2 and 4, each of the ball valves 4 includes a primary pipe 41, and a secondary pipe 42 that is transversely connected to the primary pipe 41. The primary pipe 41 is configured to be received in the accommodating space 324 of the one of the plurality of supporting arms 32, and the secondary pipe 42 is configured to extend through the opening 33 that is formed on the one of the plurality of supporting arms 32. In this embodiment, the primary pipes 41 of the ball valves 4 are respectively received in the accommodating spaces 324 of the two supporting arms 32 that are formed with the openings 33, and the secondary pipes 42 of the ball valves 4 respectively extend through the openings 33 formed on the two of the supporting arms 32, so that the ball valves 4 may be flatly stored in the stand 3.

It should be noted that, the openings 33 may be designed to have distinct widths based on diameters of the secondary pipes 42 of the ball valves 4. In this embodiment, the secondary pipes 42 have different diameters. Therefore, the openings 33 have distinct widths to allow the secondary pipes 42 of the ball valves 4 to extend through the openings 33, respectively, but the widths of the openings 33 may not be limited to those of this embodiment. In other embodiments, even though the openings 33 may have distinct widths, the secondary pipes 42 having a same diameter may still respectively extend through the openings 33 provided that a smaller one of the openings 33 has the width that is greater than the diameter of the secondary pipes 42.

The number of the ball valves 4 and the number of the openings 33 are both not limited to two. The number of the openings 33 may be adjusted based on the number of the supporting arms 32, and the number of the ball valves 4 may be adjusted based on the number of the openings 33 available. For example, when the number of the supporting arms 32 is four, the number of the openings 33 may be four, which allows for a maximum of four of the ball valves 4 to be stored respectively in the supporting arms 32. In certain embodiments, the number of the openings 33 may be only one, which allows for only one of the ball valves 4 to be stored in the supporting arms 32. In other embodiments, the number of the openings 33 may be more than one but only one of the ball valves 4 is stored in the supporting arms 32. Implementation of the number of ball valves 4 and the number of the openings 33 is not limited to those disclosed herein.

Referring to FIGS. 1 and 2, during a packaging process of the storage tank 1, the body 2 is first placed inside a box 10 with the top portion 21 of the body 2 facing upwardly with respect to the up-down direction (Z). Then, the stand 3 is disposed on the top portion 21 of the body 2. Finally, the ball valves 4 are disposed in the stand 3.

Referring to FIGS. 2 and 3, when the stand 3 is being disposed on the top portion 21 of the body 2, the supporting walls 321 face the top portion 21, and the pipe socket 312 is sleeved on the connection pipe 24. By virtue of the abutting parts 327 abutting against the top portion 21 that is curvedly shaped, the flange 34 may be flush with a top cover of the box 10 to facilitate the packaging process.

Referring to FIGS. 1 and 4, when the ball valves 4 are disposed in the stand 3, with the primary pipes 41 being respectively received in the accommodating spaces 324 of the two of the supporting arms 32 and the secondary pipes 42 being respectively extended through the openings 33 of the two of the supporting arms 32, the ball valves 4 may be flatly stored in the stand 3.

Referring to FIGS. 1 and 6, during assembly of the storage tank 1, a user first takes the ball valves 4 out of the stand 3, and chooses one of the ball valves 4 to be installed on the connection pipe 24. Then, the stand 3 is mounted onto the bottom portion 22 of the body 2. Specifically, the positioning columns 25 of the body 2 are inserted respectively into the positioning holes 323 of the supporting arms 32 when the stand 3 is being mounted to the bottom portion 22, so that the body 2 and the stand 3 may be firmly and correctly connected.

In sum, by virtue of the stand 3 having the accommodating spaces 324 and the openings 33, the ball valves 4 can be stored in the stand 3, and do not need to be packaged separately during the packaging process of the storage tank 1. Furthermore, the stand 3 may protect the ball valves 4 from being damaged during transportation of the storage tank 1.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is (are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A storage tank, comprising:

a body including a top portion, a bottom portion opposite to said top portion, and a lateral wall portion interconnecting said top portion and said bottom portion;

a stand detachably disposed on one of said top portion and said bottom portion of said body, said stand including a base and a plurality of supporting arms connected to said base, said stand having an opening formed on one of said plurality of supporting arms, wherein each of said plurality of supporting arms includes a supporting wall for abutting against one of said top portion and said bottom portion of said body, and a surrounding wall connected to a periphery of said supporting wall, said supporting wall cooperating with said surrounding wall to define an accommodating space, said opening being formed on said surrounding wall of the one of said plurality of supporting arms and being in spatial communication with the accommodating space; and a ball valve including a primary pipe, and a secondary pipe that is transversely connected to said primary pipe, said primary pipe being configured to be received in the accommodating space of the one of said plurality of supporting arms, said secondary pipe being configured to extend through said opening formed on the one of said plurality of supporting arms.

2. The storage tank as claimed in claim 1, wherein said stand further includes a flange that is disposed on said plurality of supporting arms and that is opposite to said supporting walls of said plurality of supporting arms, said flange being in parallel to a transverse plane of said body when said stand is disposed on one of said top portion and said bottom portion.

3. The storage tank as claimed in claim 1, wherein said storage tank includes two of said ball valves, said stand having two of said openings, said openings being respectively formed on said surrounding walls of two of said plurality of supporting arms;

wherein said primary pipes of said ball valves are configured to be respectively received in the accommodating spaces of the two of said plurality of supporting arms formed with said openings; and wherein said secondary pipes of said ball valves are configured to respectively extend through said openings formed on the two of said plurality of supporting arms.

4. The storage tank as claimed in claim 3, wherein said secondary pipes have different diameters, and said openings have distinct widths based on the diameters of said secondary pipes.

5. The storage tank as claimed in claim 1, wherein said body further includes a connection pipe that is disposed on said top portion of said body;

wherein said base of said stand has a basal surface that is connected to said supporting walls of said plurality of supporting arms, and a pipe socket that is disposed on said basal surface; and wherein said pipe socket is sleeved on said connection pipe when said stand is disposed on said top portion of said body.

6. The storage tank as claimed in claim 1, wherein said stand includes four of said plurality of supporting arms, said supporting arms being angularly spaced apart from each other around said base.

7. The storage tank as claimed in claim 1, wherein said top portion and said bottom portion of said body are curvedly shaped; and wherein said supporting wall of each of said plurality of supporting arms includes a connecting part that is connected to said base, an elevating part that is connected to said connecting part, and an abutting part that is connected to said elevating part, said abutting part extending from said elevating part and inclining toward said body so as to conform to the shapes of said top portion and said bottom portion of said body.

8. The storage tank as claimed in claim 1, wherein said body further includes a plurality of positioning columns that are disposed on said bottom portion of said body;

wherein each of said plurality of supporting arms has a positioning hole formed on said supporting wall; and wherein said positioning columns are respectively inserted into said positioning holes of said plurality of supporting arms when said stand is disposed on said bottom portion of said body.

* * * * *